US005445121A

United States Patent [19]

Kai

[11] Patent Number: 5,445,121

[45] Date of Patent: Aug. 29, 1995

[54] ENGINE OPERATIONAL CONTROL UNIT

[75] Inventor: Manabu Kai, Iwata, Japan

[73] Assignee: Yamaha Hatsudoki Kabushiki Kaisha, Iwata, Japan

[21] Appl. No.: 157,932

[22] Filed: Nov. 24, 1993

[30] Foreign Application Priority Data

Nov. 24, 1992 [JP] Japan ..... 4-21056

[51] Int. Cl.[6] ..... F02B 77/00

[52] U.S. Cl. ..... 123/198 DC

[58] Field of Search ..... 123/198 D, 198 DB, 198 DC

[56] References Cited

U.S. PATENT DOCUMENTS 4,155,418 5/1979 Tremblay et al. ..... 123/198 DB
4,213,513 7/1980 Beck ..... 123/198 DC
4,960,091 10/1990 Aufmkolk ..... 123/198 D
4,969,431 11/1990 Wataya ..... 123/198 D
5,193,506 3/1993 Ironside et al. ..... 123/198 D
5,235,951 8/1993 Taguchi et al. ..... 123/198 DB

FOREIGN PATENT DOCUMENTS 421056 4/1992 Japan .

*Primary Examiner*—Noah P. Kamen
*Attorney, Agent, or Firm*—Knobbe, Martens, Olson & Bear

[57] ABSTRACT

An engine operational control unit for an internal combustion engine which protects an engine in the event of abnormal condition of the throttle mechanisms by discontinuing operation of the ignition or the ignition and fuel injection dependent upon engine speed. In this way, the engine is protected from overheating if operating at a high speed, and from wetting or fouling of the spark plugs if operating at a lower speed, if abnormal conditions prevail.

31 Claims, 4 Drawing Sheets

ENGINE OPERATIONAL CONTROL UNIT

BACKGROUND OF THE INVENTION

This invention relates to an engine operational control unit and more particularly to a method and apparatus for controlling an engine under abnormal conditions.

A common form of throttle control for an internal combustion engine has a remotely positioned throttle control operated by the operator. This throttle control is connected by means of an interconnecting mechanism such as a howden wire actuator or the like to the actual throttle of the engine for controlling the engine speed. However, in some instances, due to various forms of malfunction, the actual position of the throttle of the engine may not coincide in position with the operator throttle control. When this occurs, there is obviously a serious problem that requires protective action.

For example, in many types of vehicles, the throttle control and interconnecting mechanism is exposed to severe atmospheric conditions that can adversely affect the operation. For example, in snowmobiles the throttle linkage or bowden wire mechanism can easily become encrusted with ice or snow, and the throttle of the engine may become stuck in a position that can cause problems.

It has been proposed to provide a comparator that senses the position of the throttle control and the throttle and which will shut off the engine by discontinuing the supply of current to the spark plugs for their firing when this condition occurs. Although this system has advantages, it can present certain difficulties.

For example, if the ignition is shut off while the engine is running, the engine will obviously not stop immediately. As a result, the engine will operate as a pump and will draw fuel into the engine and discharge it to the atmosphere until the engine stops turning. This can give rise to problems not only with emission, but also can give difficulties on restarting.

For example, if fuel continues to be pumped through the engine when the ignition is shut off, the spark plugs will become wetted and foul, and restarting with the same spark plugs can very well become impossible.

A solution to this problem would be to also discontinue the supply of fuel to the engine when the ignition is shut off. However, this can be detrimental to the engine. For example, if the engine has been running at-a high speed, and a discrepancy occurs between the position of the throttle control and the position of the throttle, and the ignition and the fuel supply are shut off, then the engine will be deprived of any fuel while it continues to turn. This will mean that there is no cooling of the engine due to the vaporization of the fuel, and damage to the engine can result.

It is, therefore, an object of this invention to provide an improved engine control method and apparatus for protecting an engine in the event of abnormal conditions.

It is a further object of this invention to provide an improved engine control apparatus and method for protecting an engine by discontinuing its operation under abnormal conditions, but at the same time ensuring that damage to the engine will not occur and restarting is facilitated.

Another difficulty with the stopping of an engine under the abnormal condition of throttle position and throttle control position is that restarting of the engine can be difficult, as aforenoted. In addition to the wetting of the spark plugs and possible fouling, the ambient conditions may be such that it would be difficult or impossible to start the engine after the defect has been remedied.

It is, therefore, a still further object of this invention to provide an engine control apparatus and method for protecting an engine in the event of an abnormal condition by discontinuing its operation but then re-energizing the engine once the speed has fallen to a safe speed and maintaining the running at that new, safe, lower speed.

SUMMARY OF THE INVENTION

A first feature of this invention is adapted to be embodied in a method and apparatus for engine control for an internal combustion engine having the charge forming system for supplying fuel to the engine and an ignition system for firing a charge in the engine for combustion and operation of the engine. A throttle is provided for controlling the speed of the engine, and a throttle position sensor is incorporated for providing a signal indicative of the throttle position. In addition, an operator throttle control is operably connected to the throttle for manual positioning thereof. A throttle control position sensor is supplied for providing a signal indicative of the position of the throttle control.

In accordance with an apparatus for performing the control, a comparator means is provided that senses when a discrepancy occurs between the position of the throttle control and the position of the throttle. If such an abnormal condition is sensed, means are provided for both disabling the ignition and discontinuing the supply of fuel by the charge forming system.

A method for performing this invention compares the position of the throttle control and the throttle, and indicates an abnormal condition if they are not coincident. upon the indication of an abnormal condition, both ignition and the supply of fuel to the charge former are discontinued.

Another feature of the invention is also adapted to be embodied in an engine control for an internal combustion engine that is comprised of a charge forming system for supplying fuel to the engine and an ignition system for firing a charge in the engine for combustion and operation of the engine. A throttle control for controlling the speed of the engine is provided, and a throttle position sensor provides a signal indicative of the position of the throttle. An operator throttle control is operably connected to the throttle for manually positioning the throttle. A throttle control position sensor senses the position of the throttle control. Means are provided for also sensing the speed of the engine.

In accordance with an apparatus for performing this invention, if the throttle control and throttle position sensors do not indicate that both the throttle control and throttle are in the same positions, and if the speed of the engine is greater than a predetermined speed, the ignition is interrupted. Once the speed of the engine falls below the predetermined speed, the ignition is reinitiated so that the engine will continue to operate but at a lower speed.

In a method for performing the invention, the throttle position and throttle control position are compared. If the comparison indicates that the positions are not the same, then it is -determined if the speed is greater than a predetermined speed. If it is, the ignition is interrupted until the speed falls below the predetermined speed, and then ignition is reinitiated so that the engine will not operate at a speed greater than the predetermined speed until the condition is rectified.

DETAILED DESCRIPTION OF THE PREFERRED EMBODIMENT

Figure 1:
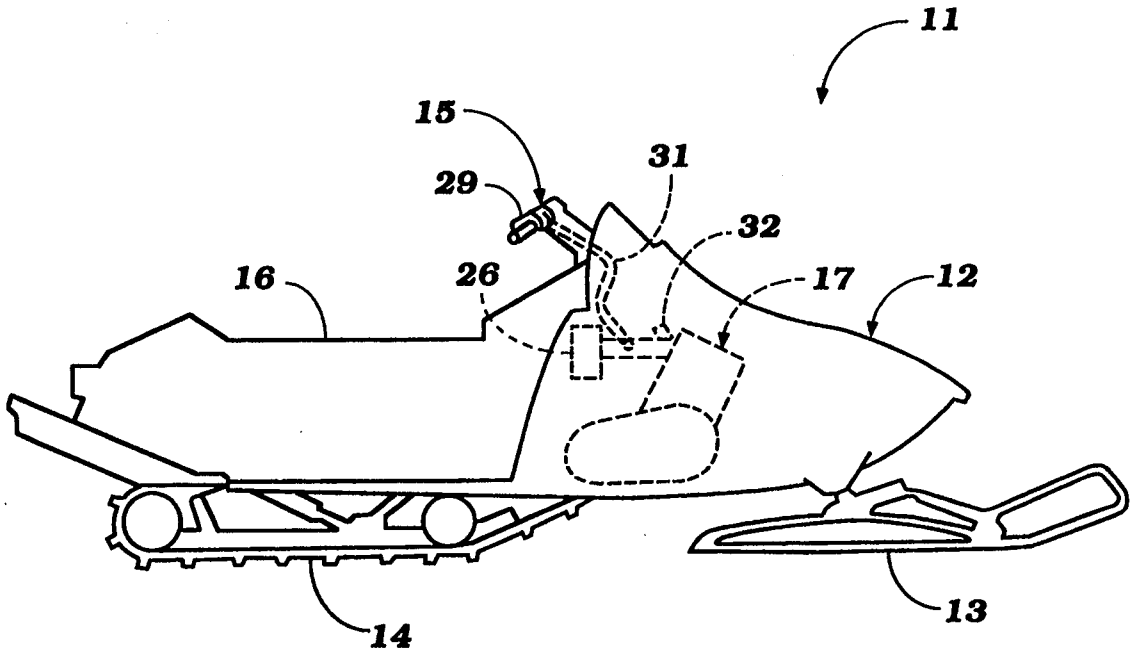
FIG. 1 is a side elevational view of a snowmobile constructed in accordance with an embodiment of the invention.

Referring now in detail to the drawings and initially to FIG. 1, a snowmobile constructed and operated in accordance with an embodiment of the invention is identified generally by the reference numeral 11. The invention is described in conjunction with a snowmobile because this is a typical environment in which the invention may find the utility. As will become apparent, the invention deals primarily with the controls for the powering internal combustion engine of the snowmobile 11 and snowmobiles provide the type of environment where the invention, which protects against certain types of malfunctions in the throttle control mechanism, are useful. It will be obvious to those skilled in the art that the invention can be employed with other applications for internal combustion engines.

The snowmobile 11 includes a body 12 that is suspended upon a pair of steering skis 13 at the front and a drive belt 14 at the rear. The skis 13 and drive belt 14 suspend the body 13 through any known type of suspension systems.

A handle bar assembly 15 is supported on the body 12 forwardly of a rider's seat 16 for controlling the steering of the skis 13 in a well-known manner. Other controls for the snowmobile 11 are also carried by the handle bar assembly 15, as will become apparent.

Figure 2:
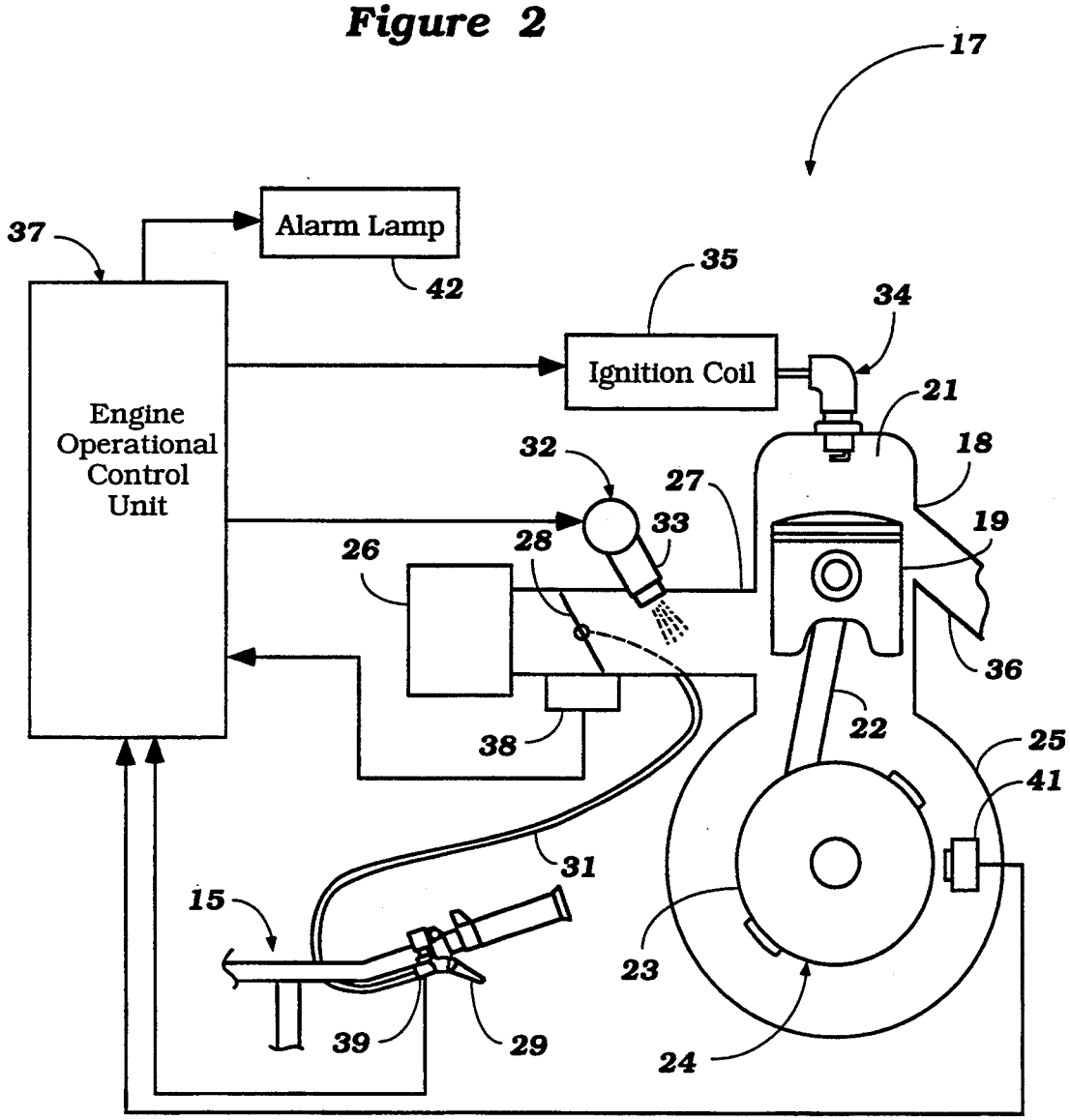
FIG. 2 is a partially schematic cross-sectional view taken through a single cylinder of the engine and shows the interrelationship with the throttle control and other controls for the system.

An internal combustion engine, indicated generally by the reference numeral 17 and shown in most detail in FIG. 2, is mounted in the body 12 and drives the drive belt 14 through a suitable transmission which includes a centrifugal clutch (not shown).

Referring now in detail to FIG. 2, the engine 17 is depicted partially in schematic form and as a cross-section through a single cylinder. Since the internal details of the engine 17 are not necessary to understand the construction and operation of the invention, they will be described only summarily. Where a detailed description is omitted, it may be considered to be conventional.

The engine 17 includes a cylinder block 18 having one or more cylinder bores in which pistons 19 are supported for reciprocation. The pistons 19 and cylinder bores as well as an attached cylinder head define a combustion chamber 21.

The pistons 19 are connected by means of connecting rods 22 to the throws 23 of a crankshaft, indicated generally by the reference numeral 24, and supported within a crankcase 25 in a known manner. In the illustrated embodiment, the engine 17 operates on a two-stroke crankcase compression principle, although it should be readily apparent to those skilled in the art that the invention can be employed with engines operating on other principles.

As a two-stroke engine, the crankcase chambers associated with each of the pistons 19 are sealed from each other and a fuel/air charge is delivered to the crankcase chambers through an/.induction system that includes an air cleaner 26 which draws atmospheric air from within the body 12 and delivers it to an induction manifold 27. A flow controlling throttle valve 28 is provided in the induction manifold 27 and the throttle valve 28 is controlled by a throttle lever 29 mounted on one side of the handle bar assembly 15. A bowden wire actuator 31 or other motion transmitting mechanism interconnects the throttle control lever 29 with the throttle valve 28.

A charge forming system is provided for supplying a fuel/air charge to the intake manifold 27 and in the illustrated embodiment, this charge-forming embodiment includes an electrically operated fuel injector 32 having a discharge nozzle 33 that sprays fuel into the intake manifold 27 downstream of the throttle valves 28. Although manifold injection is disclosed, it is to be understood that the invention may also be employed in conjunction with direct cylinder injection or other types of charge-forming systems such as carburetors or the like.

The charge formed in the induction system is delivered to the crankcase chambers through the intake manifold 27 and reed-type check valves (not shown) are provided at the discharge point so as to preclude reverse flow when the charge is being compressed by the downward movement of the pistons 19, as is well-known in this art.

The charge compressed in the crankcase chambers is then transferred to the combustion chambers 21 by scavenging passages (not shown). This charge is then fired by a spark plug 34 mounted in the cylinder head of the engine and having its spark gap extending into the combustion chamber 21. An ignition coil 35 connected to the spark plug 34 for its firing and the ignition coil 35 is controlled, in a manner which will be described.

When the charge in the combustion chamber 21 is fired by the spark plug 34, the pistons 19 will be driven downwardly and eventually will open exhaust ports 36 which communicate with an exhaust system (not shown) for the discharge of the exhaust gases to the atmosphere.

The fuel injector 32 and ignition system including the ignition coil 35 are controlled by an engine operational control unit, indicated generally by the reference numeral 37 and which receives certain signals from the engine 17 and ambient conditions, if desired, so as to provide the appropriate timing and duration of fuel injection by the injector 32 and timing of firing of the spark plug 34. Since the basic engine control may be of any known type, further details of its construction are not believed to be necessary to understand the construction and operation of the invention.

The construction thus far described may be considered to be conventional and, for that reason and as previously noted, full details of the construction are not believed to be necessary to understand the construction and operation of the invention. The invention deals primarily with a system for protecting the engine 17 in the event of an abnormal condition, this being nonconcurrence of the position of the throttle control 29 and the throttle valve 28. Such condition can occur due to encrustation of the wire actuator 31 or other throttle actuating mechanism. As previously noted, this can present certain difficulties and the invention deals with a system for protecting against such problem.

The engine protection system includes a throttle position detector 38 that outputs a signal to the engine operational control unit 37 which is indicative of the position of the throttle valve 28. In addition, a throttle lever control position sensor 39 is mounted on the handle bar assembly 15 and cooperates with the throttle control lever 29 so as to output a signal to the engine operational control unit 37 indicative of throttle control lever position.

There is further provided an engine speed sensor 41 of any known type which cooperates with the crankshaft 24 for providing output pulses for each revolution of the crankshaft 24 so as to provide data by which the engine operational control unit 37 may determine engine speed N. It should be noted that some or all of the sensors 38, 39 and 41 may also be employed in the basic engine control.

The system further includes a warning or alarm lamp 42 that is mounted in proximity to the handle bar assembly 15 so that the operator will be warned of certain malfunctions in accordance with the control routine, to be described.

As has been previously noted, the basic control for the ignition coil 35 and fuel injector 32 may be of any known type and the normal control operation will, therefore, not be described. Only the system for determining abnormal engine conditions and the protective action associated therewith will be described by reference to FIGS. 3 and 4. Basically, the control routine functions so as to compare the relative positions of the throttle control lever 29 and throttle valve 28, and if their positions do not coincide, then it is determined if the engine speed N is greater than a predetermined relatively high engine speed $N_1$. If the speed is greater than this speed, then the ignition is shut off by discontinuing the ignition signal from the operational control unit 37 to the ignition coil 35. If the engine is operating at a higher speed than the speed $N_1$, it is not desirable to discontinue the fuel injection because this will possibly cause overheating damage to the engine.

Also, if the engine speed N is greater than or equal to a predetermined lower speed $N_2$, when fuel shut off is safe then the fuel injection amount is also discontinued by having the engine operational control unit 37 discontinue actuation of the fuel injector 32.

Figure 3:
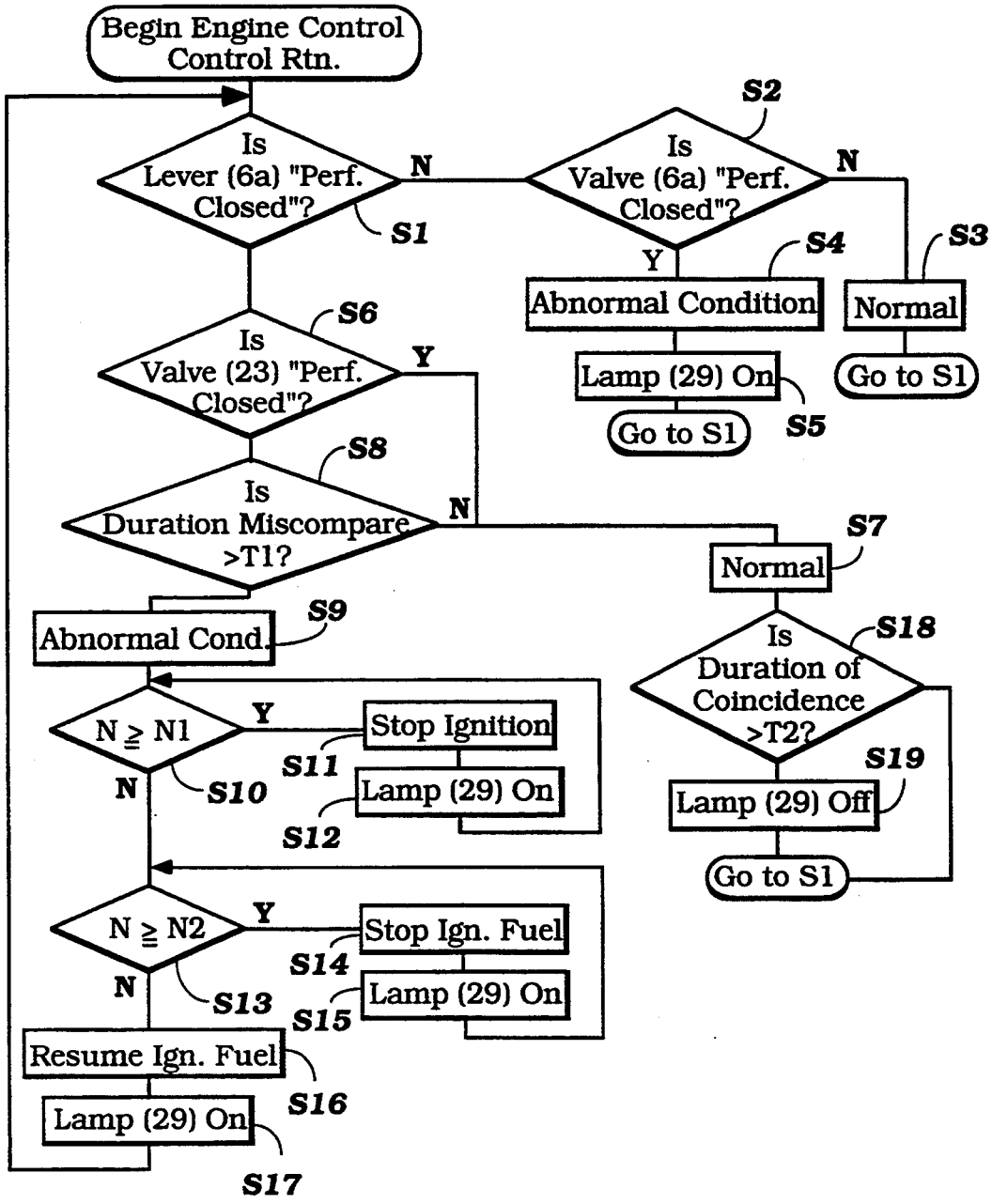
FIG. 3 is a block diagram of the control routine.

The specific control routine will now be described by particular reference to FIG. 3, which is a block diagram of the control routine and FIG. 4 which is a time history showing the relation of throttle control position, throttle valve position, engine speed, ignition command, fuel injection command and alarm lamp condition. The program begins and moves to the step S1 to determine if the throttle control lever 29 is in its closed or idle position. In this control routine, abnormal conditions are determined if either the throttle control 29 is in its idle position and the throttle valve 28 is not in its idle position, or if the throttle control lever 29 is in an open position and the throttle valve 28 is retained in an idle position.

If at the step S1 it is determined that the throttle control lever 29 is not in its idle or closed position, the program then moves to the step S2 to determine if the throttle valve 28 is in its idle or closed position. This is determined by the output from the throttle position sensor 38. If the throttle valve 28 is determined at the step S2 to be not in its idle condition, then the program moves to the step S3 which determines normal engine operation and the program repeats back to the step S1.

Figure 4:
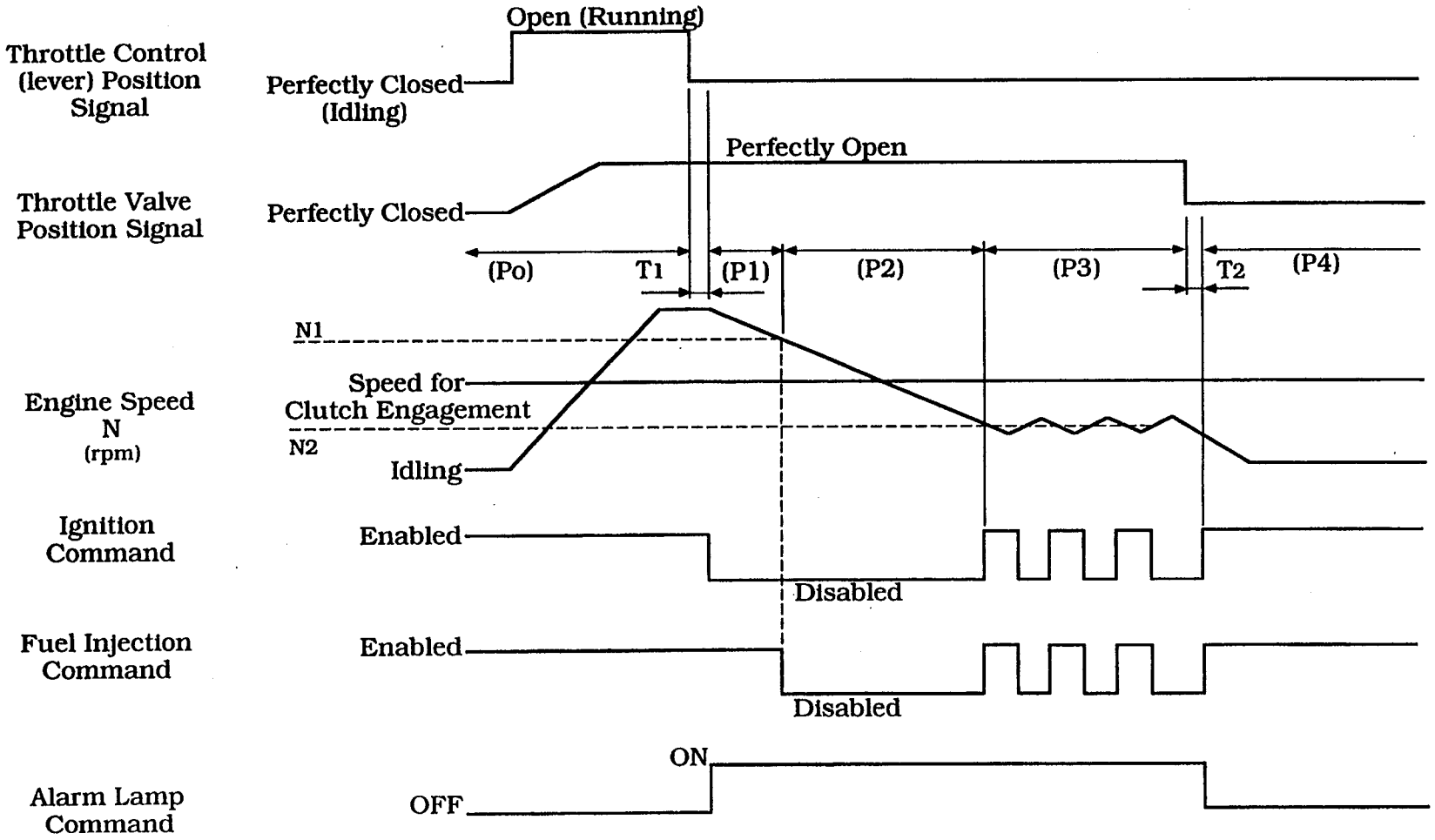
FIG. 4 is a graphical view showing the conditions of the various position detectors, engine speed, ignition, fuel injection and alarm lamps to understand the operation of the control routine.

This condition occurs as shown at the lefthand side of the time history of FIG. 4 wherein both the throttle control lever and the throttle valve are not in their idle positions.

If, however, at the step S2, it is determined that the throttle valve 28 is not in its idle condition, then the program moves to the step S4 so as to determine the existence of an abnormal condition. The program then moves to the step S5 so as to turn on the alarm lamp 42 and warn the operator. The program then returns to the step S1.

In the condition as thus far described, the throttle lever has been determined initially to be in an open position but the throttle valve 28 has been stuck in a closed or idle position. The operator need be warned in this situation but no protective action is required under this particular running condition.

When the program returns to the step S1, and it is determined either then or initially that the throttle control lever 29 is perfectly closed, then the program moves to the step S6 to read the position of the throttle valve 28 again by the throttle position sensor 38. If the throttle valve 28 is perfectly closed, then the program moves to the step S7 so as to indicate a normal condition. And this control routine will be described later.

If, however, at the step S6 it is determined that the throttle valve 28 is not perfectly closed, then the program moves to the step S8 to determine if the time when the throttle valve has not been perfectly closed but the throttle control level is closed exceeds a predetermined time period $T_1$ which time period has a duration of about 0.5 seconds. This time period is chosen so as to avoid the effects of noise in the system and also to ensure that the components have had an opportunity to stabilize in the condition.

If the time period $T_1$ has not been exceeded at the step S8, the program repeats back to the step S6.

If, however, the time period $T_1$ has been exceeded as shown in FIG. 4, then the program moves to the step S9 so as to determine that there is an abnormal condition and that protective action may be required.

The program then moves to the step S10 so as to compare the actual engine speed N with the preset relatively higher engine speed $N_1$. As may be seen in FIG. 4, the speed $N_1$ is a speed high enough that the centrifugal clutch of the snowmobile 11 will be engaged and the drive belt 14 would be driven. This may be a dangerous condition if the operator is calling for idle operation and hence, if the speed is equal to or greater than the speed $N_1$, the program moves to the step S10 so as to discontinue the ignition. As noted, this is done by having the operational control unit 37 discontinue the supply of power to the ignition coil 35.

The program then moves to the step S12 so as to turn on the warning light 42 and then repeats back to the step S10 to determine if the engine speed has fallen to a speed below the speed $N_1$. If it has not, the program continues to repeat so as to discontinue the firing of the spark plugs 34. However, it should be noted at this time that no fuel injection termination occurs because of the high speed at which the engine 17 is running.

Once the engine speed falls below or equal to the engine speed $N_1$, then the program moves to the step S13 to determine if the engine speed N is equal to or greater than the lower engine speed $N_2$. The speed $N_2$ is set as a speed slightly above idle speed but a speed below that at which the centrifugal clutch that drives the drive belt 14 would be engaged. This speed is chosen so as to ensure that the engine will continue running but not at such a high rate of speed that there will be any danger. Because of the environment at which the snowmobile exists, it is not desirable to completely shut down the engine merely because the throttle valve position does not coincide with the throttle control position so long as the speed is kept relatively low.

If, at the step S13, it is determined that the speed of the engine N is greater than or equal to the speed $N_2$, this condition occurring during the time periods $P_1$ and $P_2$ in FIG. 4, then the program initiates the step S14 wherein both fuel injection and ignition are discontinued. The program then moves to the step S15 so as to maintain the warning light 42 in its ON condition. The program then repeats to the step S13.

Assuming at the return to the step S13, the engine speed has fallen to a speed equal to or less than the speed $N_2$, the program then moves to the step S16 so as to resume the firing of the spark plugs 34 and fuel injection by the fuel injector 32 while still retaining the warning lamp 42 on. The program then repeats back to the step S1. As may be seen from FIG. 4, this operation assuming the malfunction condition maintains will ensure that the engine is running at a speed approximately equal to the speed $N_2$ and will not be completely stopped.

Returning now to the step S7 when it is determined that the conditions may be determined to be normal, the program then moves to the step S18 to determine if this normal condition occurs for a time period at least equal to a time period $T_2$. This time period may also be approximately 0.5 seconds and appears at the end of the $P_3$ time period in FIG. 4. If the time period of normalcy exceeds the time period $T_2$, then it is determined that the abnormal condition has ceased to exist and the program moves to the step S19 to turn off the warning lamp 42 and the program then returns to the step S1.

It should be understood that the described control routine is designed primarily for conditions where the throttle control lever 29 is in the idle position and the throttle valve 28 is not in the idle position or when the throttle control lever 29 is in the off idle or open condition and the throttle valve 28 is stuck in the idle condition. Of course, it should be readily apparent to those skilled in the art how the control routine may also be practiced under other conditions when the position of the throttle control lever 29 and throttle valve 28 do not coincide. Also, it is to be understood that the described construction is that of a preferred embodiment of the invention and various other changes and modifications may be made without departing from the spirit and scope of the invention, as defined by the appended claims.

What is claimed is:

1. An engine control for an internal combustion engine comprising a charge forming system for supplying fuel to said engine, an ignition system for firing a charge in said engine for combustion and operation of said engine,..a throttle for controlling the speed of said engine, a throttle position sensor for sensing the position of said throttle, an operator throttle control operably connected to said throttle for manual positioning thereof, a throttle control position sensor for sensing the position of said throttle control, comparator means for comparing the outputs of said throttle position sensor and said throttle control position sensor and providing an abnormal condition signal when said sensors are not coincident, means for discontinuing the firing of the ignition system and the supply of fuel from the charge forming system in response to the sensing of the abnormal condition, and means for sensing the speed of the engine, the discontinuance of the firing of the ignition system and the supply of fuel from the charge forming system being determined depending upon the speed of the engine.

2. An engine control for an internal combustion engine as set forth in claim 1, wherein the ignition of the engine is discontinued when the speed of the engine is greater than a first predetermined speed.

3. An engine control for an internal combustion engine as set forth in claim 2, wherein the discontinuing of the supply of fuel from the charge forming system is initiated at a second predetermined speed.

4. An engine control for an internal combustion engine as set forth in claim 3, wherein the second predetermined speed is lower than the first predetermined speed.

5. An engine control for an internal combustion engine as set forth in claim 4, wherein the firing of the ignition system and the supply of fuel from the charge forming system is reinitiated when the speed of the engine falls below the second predetermined speed and is again discontinued when the speed exceeds the second predetermined speed.

6. An engine control for an internal combustion engine as set forth in claim 1, wherein the comparator means compares the position of the throttle control position sensor and the throttle position sensor when the throttle control position sensor indicates that the throttle control is in an idle and means for discontinuing the firing of the ignition condition.

7. An engine control for an internal combustion engine as set forth in claim 6, further including means for providing a warning signal when the throttle control position sensor indicates that the throttle control is not in its idle position and the throttle position sensor indicates that the throttle position is in its idle condition.

8. An engine control for an internal combustion engine as set forth in claim 6, wherein the ignition of the engine is discontinued when the speed of the engine is greater than a first predetermined speed.

9. An engine control for an internal combustion engine as set forth in claim 8, wherein the discontinuing of the supply of fuel from the charge forming system is initiated at a second predetermined speed.

10. An engine control for an internal combustion engine as set forth in claim 9, wherein the second predetermined speed is lower than the first predetermined speed.

11. An engine control for an internal combustion engine as set forth in claim 10, wherein the firing of the ignition system and the supply of fuel from the charge forming system is reinitiated when the speed of the engine falls below the second predetermined speed and is again discontinued when the speed exceeds the second predetermined speed.

12. An engine control for an internal combustion engine as set forth in claim 11, further including means for providing a warning signal when the throttle control position sensor indicates that the throttle control is not in its idle position and the throttle position sensor indicates that the throttle position is in its idle condition.

13. An engine control for an internal combustion engine comprising an ignition system for firing a charge in the engine for combustion and operation of said engine, a throttle control for controlling the speed of said engine, a throttle position sensor for sensing the position of said throttle control, an operator throttle control operably connected to said throttle for manual positioning thereof, a throttle control position sensor for sensing the position of said throttle control, means for sensing the speed of said engine, and comparator means for sensing when the position of said operator throttle control and said throttle control are not coincident and discontinuing the operation of said ignition system if the engine speed sensor indicates the engine speed is above a predetermined speed until the speed of the engine falls below a predetermined speed.

14. An engine control for an internal combustion engine as set forth in claim 13, further including the reinitiation of the operation of the ignition system when the engine speed falls below the predetermined speed.

15. An engine control for an internal combustion engine as set forth in claim 13, further including a charge forming system for supplying a fuel charge to the engine and means for discontinuing the supply of fuel to the engine from the charge forming system when the predetermined conditions are met.

16. An engine control for an internal combustion engine as set forth in claim 15, wherein the supply of fuel to the engine from the charge forming system and the firing of the ignition system are reinitiated when the engine speed falls below the predetermined speed.

17. An engine control for an internal combustion engine as set forth in claim 16, further including means for discontinuing the firing of the ignition system only when the engine speed is above a second predetermined engine speed higher than the first predetermined engine speed.

18. An engine control method for internal combustion engine comprising a charge forming system for supplying fuel to said engine, an ignition system for firing a charge in said engine for combustion and operation of said engine, a throttle for controlling the speed of said engine, an operator throttle control operably connected to said throttle for manual position thereof, said method comprising the steps of determining the position of said throttle, determining the position of said throttle control, comparing the positions of said throttle and said throttle control and providing an abnormal condition signal when said sensors are not coincident, discontinuing the firing of the ignition system and the supply of fuel form the charge forming system in response to the signal condition, sensing the speed of the engine and wherein the discontinuance of the firing of the ignition system and the supply of fuel form the charge forming system is determined depending upon the speed of the engine.

19. An engine control method for an internal combustion engine as set forth in claim 18, wherein the ignition of the engine is discontinued when the speed of the engine is greater than a first predetermined speed.

20. An engine control method for an internal combustion engine as set forth in claim 19, wherein the discontinuing of the supply of fuel from the charge forming system is initiated at a second predetermined speed.

21. An engine control method for an internal combustion engine as set forth in claim 20, wherein the second predetermined speed is lower than the first predetermined speed.

22. An engine control method for an internal combustion engine as set forth in claim 21, further including the step of providing a warning signal when the throttle control is not in its idle position and the throttle is in its idle condition.

23. An engine control method for an internal combustion engine as set forth in claim 21, wherein the firing of the ignition system and the supply of fuel from the charge forming system is reinitiated when the speed of the engine falls below the second predetermined speed and is again discontinued when the speed exceeds the second predetermined speed.

24. An engine control method for an internal combustion engine as set forth in claim 21, further including sensing the speed of the engine and discontinuing the firing of the ignition system and the supply of fuel from the charge forming system is dependent upon the speed of the engine.

25. An engine control method for an internal combustion engine as set forth in claim 24, wherein the ignition of the engine is discontinued when the speed of the engine is greater than a first predetermined speed.

26. An engine control method for an internal combustion engine as set forth in claim 25, wherein the discontinuing of the supply of fuel from the charge forming system is initiated at a second predetermined speed.

27. An engine control method for an internal combustion engine comprising an ignition system for firing a charge in the engine for combustion and operation of said engine, a throttle control for controlling the speed of said engine, an operator throttle control operably connected to said throttle for manual positioning thereof, said method comprising the steps of sensing the position of said throttle, sensing the position of said throttle, sensing the speed of said engine, and if the position of said operator throttle control and said throttle control are not coincident discontinuing the operation of said ignition system if the engine speed is above a predetermined speed until the speed of the engine falls below a predetermined speed.

28. An engine control method for an internal combustion engine as set forth in claim 27, further including reinitiation of the operation of the ignition system when the engine speed falls below the predetermined speed.

29. An engine control meted for an internal combustion engine as set forth in claim 27, wherein the engine further includes a charge forming system for supplying a fuel charge to the engine and the step of discontinuing the supply of fuel to the engine from the charge forming system when the predetermined conditions are met.

30. An engine control method for an internal combustion engine as set forth in claim 29, wherein the supply of fuel to the engine from the charge forming system and the firing of the ignition system are reinitiated when the engine speed falls below the predetermined speed.

31. An engine control method for an internal combustion engine as set forth in claim 30, further including discontinuing the firing of the ignition system only when the engine speed is above a second predetermined engine speed higher than the first predetermined engine speed.

* * * * *